US010094371B2

(12) United States Patent
Mills

(10) Patent No.: US 10,094,371 B2
(45) Date of Patent: Oct. 9, 2018

(54) METHODS AND APPARATUS TO DETERMINE OPERATING PARAMETERS OF A PUMPING UNIT FOR USE WITH WELLS

(71) Applicant: Bristol, Inc., Watertown, CT (US)

(72) Inventor: Thomas Matthew Mills, Katy, TX (US)

(73) Assignee: BRISTOL, INC., Houston, TX (US)

( * ) Notice: Subject to any disclaimer, the term of this patent is extended or adjusted under 35 U.S.C. 154(b) by 916 days.

(21) Appl. No.: 14/321,528

(22) Filed: Jul. 1, 2014

(65) Prior Publication Data

US 2016/0003236 A1 Jan. 7, 2016

(51) Int. Cl.

| | |
|---|---|
| ***F04B 49/20*** | (2006.01) |
| ***F04B 49/06*** | (2006.01) |
| ***F04B 47/02*** | (2006.01) |
| ***F04B 53/00*** | (2006.01) |
| ***F04B 53/14*** | (2006.01) |
| ***E21B 43/12*** | (2006.01) |

(52) U.S. Cl.

CPC ..... *F04B 49/20* (2013.01); *E21B 43/127* (2013.01); *F04B 47/022* (2013.01); *F04B 47/026* (2013.01); *F04B 49/065* (2013.01); *F04B 53/006* (2013.01); *F04B 53/144* (2013.01); *F04B 2201/121* (2013.01)

(58) Field of Classification Search

CPC .. F04B 47/022; F04B 47/028; F04B 47/2201; F04B 47/0201; F04B 2201/0207; F04B 2201/02071; F04B 2201/1201; F04B 2201/1202; F04B 2201/1203; F04B 2201/12041; F04B 2201/121; F04B 2201/1211; F04B 2203/0207; F04B 2203/0208; F04B 2203/0209; F04B 2203/0213; F04B 53/006; F04B 53/144; E21B 47/0007; E21B 47/0008

See application file for complete search history.

(56) References Cited

U.S. PATENT DOCUMENTS 3,029,650 A 4/1962 Byrd
3,765,234 A * 10/1973 Sievert ..... G01L 3/24 73/152.61

(Continued)

FOREIGN PATENT DOCUMENTS

CA 2744324 12/2012

OTHER PUBLICATIONS

Modern Sucker-Rod Pumping, Gabor Takacs, PennWell Books, PennWell Publishing Company, Tulsa, OK, 1993, pp. 80-91.*

(Continued)

*Primary Examiner* — Bryan Lettman
*Assistant Examiner* — Timothy P. Solak
(74) *Attorney, Agent, or Firm* — Hanley, Flight & Zimmerman, LLC

(57) ABSTRACT

Methods and apparatus to determine operating parameters of a pumping unit for use with wells are disclosed. An example apparatus includes a housing and a processor positioned in the housing. The processor is to determine a rate at which to operate a motor of a pumping unit to enable a load imparted on a polished rod of the pumping unit to be within a threshold of a reference load or to enable a speed of the polished rod to be within a threshold of a reference speed.

22 Claims, 15 Drawing Sheets

(56) References Cited

U.S. PATENT DOCUMENTS

| | | | | |
|---|---|---|---|---|
| 4,483,188 | A * | 11/1984 | McTamaney | H03M 7/50 346/33 WL |
| 4,490,094 | A | 12/1984 | Gibbs | |
| 4,541,274 | A | 9/1985 | Purcupile | |
| 4,661,751 | A * | 4/1987 | Werner | H02P 1/28 318/474 |
| 5,204,595 | A | 4/1993 | Opal et al. | |
| 5,291,777 | A * | 3/1994 | Chang | E21B 43/127 417/18 |
| 6,343,656 | B1 | 2/2002 | Vazquez et al. | |
| 7,547,196 | B2 | 6/2009 | Boyer et al. | |
| 8,240,221 | B2 | 8/2012 | Simpson et al. | |
| 8,444,393 | B2 | 5/2013 | Beck et al. | |
| 9,115,574 | B2 | 8/2015 | Doyle et al. | |
| 2004/0084179 | A1 | 5/2004 | Watson et al. | |
| 2005/0095140 | A1 * | 5/2005 | Boren | F04B 47/022 417/42 |
| 2006/0060011 | A1 | 3/2006 | Jensen | |
| 2006/0067834 | A1 * | 3/2006 | Boyer | F04B 47/02 417/44.1 |
| 2012/0020808 | A1 * | 1/2012 | Lawson | E21B 43/127 417/18 |
| 2013/0030721 | A1 * | 1/2013 | Palka | F04B 47/026 702/41 |
| 2014/0129037 | A1 | 5/2014 | Peterson | |
| 2016/0003234 | A1 | 1/2016 | Mills | |
| 2016/0131128 | A1 | 5/2016 | Doyle | |

OTHER PUBLICATIONS

Patent Cooperation Treaty, "International Search Report", issued in connection with PCT Patent Application No. PCT/US2015/038726, dated Dec. 10, 2015, 5 pages.

Patent Cooperation Treaty, "Written Opinion", issued in connection with PCT Patent Application No. PCT/US2015/038726, dated Dec. 10, 2015, 6 pages.

Patent Cooperation Treaty, "Communication Relating to the Results of the Partial International Search," issued in connection with PCT Patent Application No. PCT/US2015/038731, dated Dec. 17, 2015, 4 pages.

Patent Cooperation Treaty, "International Search Report," issued in connection with PCT Patent Application No. PCT/US2015/038731, dated Feb. 22, 2016, 7 pages.

Patent Cooperation Treaty, "Written Opinion," issued in connection with PCT Patent Application No. PCT/US2015/038731, dated Feb. 22, 2016, 8 pages.

United States Patent and Trademark Office, "Requirement for Restriction/Election," issued in connection with U.S. Appl. No. 14/321,543, dated Oct. 7, 2016, 6 pages.

United States Patent and Trademark Office, "Non-final Office Action," issued in connection with U.S. Appl. No. 14/321,543, dated Mar. 17, 2017, 42 pages.

Patent Cooperation Treaty, "International Preliminary Report on Patentability," issued in connection with PCT Patent Application No. PCT/US2015/038731, dated Jan. 3, 2017, 9 pages.

Patent Cooperation Treaty, "International Preliminary Report on Patentability," issued in connection with PCT Patent Application No. PCT/US2015/038726, dated Jan. 3, 2017, 7 pages.

SPOC Automation, "IronHorse Series Drive, 40 HP, 480VAC, 3 phase Air Balance Pumping Unit," retrieved on Jan. 17, 2017, [https://www.facebook.com/video/video.php?v=209887075805037], 22 pages.

United States Patent and Trademark Office, "Non-final Office Action," issued in connection with U.S. Appl. No. 14/321,543, dated Aug. 10, 2017, 18 pages.

Gabor Takacs-Gabor Ladanyi, "Calculation of Gearbox Torques Considering Inertial Effects" Geosciences and Engineering vol. 1, No. 1 (2012) pp. 283-291.

United States Patent and Trademark Office, "Final Office Action," issued in connection with U.S. Appl. No. 14/321,543, dated Feb. 27, 2018 34 pages.

* cited by examiner

400

| 402 TIME [SECS] | 404 MOTOR PULSE COUNT | 406 POSITION [INCH] | 402 TIME [SECS] | 404 MOTOR PULSE COUNT | 406 POSITION [INCH] | 402 TIME [SECS] | 404 MOTOR PULSE COUNT | 406 POSITION [INCH] | 402 TIME [SECS] | 404 MOTOR PULSE COUNT | 406 POSITION [INCH] |
|---|---|---|---|---|---|---|---|---|---|---|---|
| 0 | 0 | 12.59 | 2.05 | 237 | 74.58 | 4.05 | 458 | 72.19 | 6.05 | 698 | 11.42 |
| 0.05 | 6 | 13.81 | 2.1 | 243 | 75.70 | 4.1 | 464 | 70.93 | 6.1 | 704 | 10.30 |
| 0.1 | 12 | 15.07 | 2.15 | 249 | 76.77 | 4.15 | 470 | 69.62 | 6.15 | 710 | 9.23 |
| 0.15 | 18 | 16.38 | 2.2 | 255 | 77.79 | 4.2 | 476 | 68.27 | 6.2 | 716 | 8.21 |
| 0.2 | 24 | 17.73 | 2.25 | 261 | 78.75 | 4.25 | 482 | 66.89 | 6.25 | 722 | 7.25 |
| 0.25 | 30 | 19.11 | 2.3 | 267 | 79.66 | 4.3 | 488 | 65.47 | 6.3 | 728 | 6.34 |
| 0.3 | 36 | 20.53 | 2.35 | 273 | 80.52 | 4.35 | 494 | 64.01 | 6.35 | 734 | 5.48 |
| 0.35 | 42 | 21.99 | 2.4 | 279 | 81.31 | 4.4 | 500 | 62.52 | 6.4 | 740 | 4.69 |
| 0.4 | 48 | 23.48 | 2.45 | 285 | 82.05 | 4.45 | 506 | 61.00 | 6.45 | 746 | 3.95 |
| 0.45 | 54 | 25.00 | 2.5 | 291 | 82.73 | 4.5 | 512 | 59.46 | 6.5 | 752 | 3.27 |
| 0.5 | 60 | 26.54 | 2.55 | 297 | 83.34 | 4.55 | 518 | 57.88 | 6.55 | 758 | 2.66 |
| 0.55 | 66 | 28.12 | 2.6 | 303 | 83.90 | 4.6 | 524 | 56.29 | 6.6 | 764 | 2.10 |
| 0.6 | 72 | 29.71 | 2.65 | 309 | 84.39 | 4.65 | 530 | 54.67 | 6.65 | 770 | 1.61 |
| 0.65 | 78 | 31.33 | 2.7 | 315 | 84.81 | 4.7 | 536 | 53.04 | 6.7 | 776 | 1.19 |
| 0.7 | 84 | 32.96 | 2.75 | 321 | 85.17 | 4.75 | 542 | 51.39 | 6.75 | 782 | 0.83 |
| 0.75 | 90 | 34.61 | 2.8 | 327 | 85.47 | 4.8 | 548 | 49.73 | 6.8 | 788 | 0.53 |
| 0.8 | 96 | 36.27 | 2.85 | 333 | 85.70 | 4.85 | 554 | 48.05 | 6.85 | 794 | 0.30 |
| 0.85 | 102 | 37.95 | 2.9 | 339 | 85.87 | 4.9 | 560 | 46.37 | 6.9 | 800 | 0.13 |
| 0.9 | 108 | 39.63 | 2.95 | 344 | 85.97 | 4.95 | 566 | 44.69 | 6.95 | 806 | 0.03 |
| 0.95 | 114 | 41.31 | 3 | 349 | 86.00 | 5 | 572 | 43.00 | 7 | 812 | 0.00 |
| 1 | 119 | 43.00 | 3.05 | 354 | 85.97 | 5.05 | 578 | 41.31 | 7.05 | 818 | 0.03 |

408 410 412 420 414 416 417 418

FIG. 4A

| | | |
|---|---|---|
| 1.05 | 124 | 44.69 |
| 1.1 | 129 | 46.37 |
| 1.15 | 134 | 48.05 |
| 1.2 | 139 | 49.73 |
| 1.25 | 144 | 51.39 |
| 1.3 | 149 | 53.04 |
| 1.35 | 154 | 54.67 |
| 1.4 | 159 | 56.29 |
| 1.45 | 165 | 57.88 |
| 1.5 | 171 | 59.46 |
| 1.55 | 177 | 61.00 |
| 1.6 | 183 | 62.52 |
| 1.65 | 189 | 64.01 |
| 1.7 | 195 | 65.47 |
| 1.75 | 201 | 66.89 |
| 1.8 | 207 | 68.27 |
| 1.85 | 213 | 69.62 |
| 1.9 | 219 | 70.93 |
| 1.95 | 225 | 72.19 |
| 2 | 231 | 73.41 |

| | | |
|---|---|---|
| 3.1 | 359 | 85.87 |
| 3.15 | 364 | 85.70 |
| 3.2 | 369 | 85.47 |
| 3.25 | 374 | 85.17 |
| 3.3 | 379 | 84.81 |
| 3.35 | 384 | 84.39 |
| 3.4 | 389 | 83.90 |
| 3.45 | 394 | 83.34 |
| 3.5 | 399 | 82.73 |
| 3.55 | 404 | 82.05 |
| 3.6 | 409 | 81.31 |
| 3.65 | 414 | 80.52 |
| 3.7 | 419 | 79.66 |
| 3.75 | 424 | 78.75 |
| 3.8 | 429 | 77.79 |
| 3.85 | 434 | 76.77 |
| 3.9 | 440 | 75.70 |
| 3.95 | 446 | 74.58 |
| 4 | 452 | 73.41 |

| | | |
|---|---|---|
| 5.1 | 584 | 39.63 |
| 5.15 | 590 | 37.95 |
| 5.2 | 596 | 36.27 |
| 5.25 | 602 | 34.61 |
| 5.3 | 608 | 32.96 |
| 5.35 | 614 | 31.33 |
| 5.4 | 620 | 29.71 |
| 5.45 | 626 | 28.12 |
| 5.5 | 632 | 26.54 |
| 5.55 | 638 | 25.00 |
| 5.6 | 644 | 23.48 |
| 5.65 | 650 | 21.99 |
| 5.7 | 656 | 20.53 |
| 5.75 | 662 | 19.11 |
| 5.8 | 668 | 17.73 |
| 5.85 | 674 | 16.38 |
| 5.9 | 680 | 15.07 |
| 5.95 | 686 | 13.81 |
| 6 | 692 | 12.59 |

| | | |
|---|---|---|
| 7.1 | 824 | 0.13 |
| 7.15 | 830 | 0.30 |
| 7.2 | 836 | 0.53 |
| 7.25 | 842 | 0.83 |
| 7.3 | 848 | 1.19 |
| 7.35 | 854 | 1.61 |
| 7.4 | 860 | 2.10 |
| 7.45 | 866 | 2.66 |
| 7.5 | 872 | 3.27 |
| 7.55 | 878 | 3.95 |
| 7.6 | 884 | 4.69 |
| 7.65 | 890 | 5.48 |
| 7.7 | 896 | 6.34 |
| 7.75 | 902 | 7.25 |
| 7.8 | 908 | 8.21 |
| 7.85 | 914 | 9.23 |
| 7.9 | 920 | 10.30 |
| 7.95 | 926 | 11.42 |
| 8 | 932 | 12.59 |

FIG. 4B

500

| 502 TIME [SECS] | 504 RAW MOTOR PULSE COUNT | 506 POSITION [INCH] | 508 CRANK ANGLE [RADIANS] | 502 TIME [SECS] | 504 RAW MOTOR PULSE COUNT | 506 POSITION [INCH] | 508 CRANK ANGLE [RADIANS] | 502 TIME [SECS] | 504 RAW MOTOR PULSE COUNT | 506 POSITION [INCH] | 508 CRANK ANGLE [RADIANS] | 502 TIME [SECS] | 504 RAW MOTOR PULSE COUNT | 506 POSITION [INCH] | 508 CRANK ANGLE [RADIANS] |
|---|---|---|---|---|---|---|---|---|---|---|---|---|---|---|---|
| 6.9 | 800 | 0.13 | 0.00 | 0.9 | 108 | 39.63 | 1.62 | 2.9 | 339 | 85.87 | 3.18 | 4.9 | 560 | 46.37 | 4.6652 |
| 6.95 | 806 | 0.03 | 0.04 | 0.95 | 114 | 41.31 | 1.66 | 2.95 | 344 | 85.97 | 3.21 | 4.95 | 566 | 44.69 | 4.7056 |
| 7 | 812 | 0.00 | 0.08 | 1 | 119 | 43.00 | 1.69 | 3 | 349 | 86.00 | 3.24 | 5 | 572 | 43.00 | 4.7461 |
| 7.05 | 818 | 0.03 | 0.12 | 1.05 | 124 | 44.69 | 1.73 | 3.05 | 354 | 85.97 | 3.28 | 5.05 | 578 | 41.31 | 4.7865 |
| 7.1 | 824 | 0.13 | 0.16 | 1.1 | 129 | 46.37 | 1.76 | 3.1 | 359 | 85.87 | 3.31 | 5.1 | 584 | 39.63 | 4.827 |
| 7.15 | 830 | 0.30 | 0.20 | 1.15 | 134 | 48.05 | 1.79 | 3.15 | 364 | 85.70 | 3.34 | 5.15 | 590 | 37.95 | 4.8674 |
| 7.2 | 836 | 0.53 | 0.24 | 1.2 | 139 | 49.73 | 1.83 | 3.2 | 369 | 85.47 | 3.38 | 5.2 | 596 | 36.27 | 4.9079 |
| 7.25 | 842 | 0.83 | 0.28 | 1.25 | 144 | 51.39 | 1.86 | 3.25 | 374 | 85.17 | 3.41 | 5.25 | 602 | 34.61 | 4.9483 |
| 7.3 | 848 | 1.19 | 0.32 | 1.3 | 149 | 53.04 | 1.89 | 3.3 | 379 | 84.81 | 3.44 | 5.3 | 608 | 32.96 | 4.9888 |
| 7.35 | 854 | 1.61 | 0.36 | 1.35 | 154 | 54.67 | 1.93 | 3.35 | 384 | 84.39 | 3.48 | 5.35 | 614 | 31.33 | 5.0292 |
| 7.4 | 860 | 2.10 | 0.40 | 1.4 | 159 | 56.29 | 1.96 | 3.4 | 389 | 83.90 | 3.51 | 5.4 | 620 | 29.71 | 5.0697 |
| 7.45 | 866 | 2.66 | 0.44 | 1.45 | 165 | 57.88 | 2.00 | 3.45 | 394 | 83.34 | 3.55 | 5.45 | 626 | 28.12 | 5.1101 |
| 7.5 | 872 | 3.27 | 0.49 | 1.5 | 171 | 59.46 | 2.04 | 3.5 | 399 | 82.73 | 3.58 | 5.5 | 632 | 26.54 | 5.1506 |
| 7.55 | 878 | 3.95 | 0.53 | 1.55 | 177 | 61.00 | 2.08 | 3.55 | 404 | 82.05 | 3.61 | 5.55 | 638 | 25.00 | 5.191 |
| 7.6 | 884 | 4.69 | 0.57 | 1.6 | 183 | 62.52 | 2.12 | 3.6 | 409 | 81.31 | 3.65 | 5.6 | 644 | 23.48 | 5.2315 |
| 7.65 | 890 | 5.48 | 0.61 | 1.65 | 189 | 64.01 | 2.16 | 3.65 | 414 | 80.52 | 3.68 | 5.65 | 650 | 21.99 | 5.2719 |
| 7.7 | 896 | 6.34 | 0.65 | 1.7 | 195 | 65.47 | 2.20 | 3.7 | 419 | 79.66 | 3.71 | 5.7 | 656 | 20.53 | 5.3124 |
| 7.75 | 902 | 7.25 | 0.69 | 1.75 | 201 | 66.89 | 2.24 | 3.75 | 424 | 78.75 | 3.75 | 5.75 | 662 | 19.11 | 5.3528 |
| 7.8 | 908 | 8.21 | 0.73 | 1.8 | 207 | 68.27 | 2.29 | 3.8 | 429 | 77.79 | 3.78 | 5.8 | 668 | 17.73 | 5.3933 |

514 520 512 518 510 516

FIG. 5A

| | | | | | | | | | | | | | | | |
|---|---|---|---|---|---|---|---|---|---|---|---|---|---|---|---|
| 7.85 | 914 | 9.23 | 0.77 | 1.85 | 213 | 69.62 | 2.33 | 3.85 | 434 | 76.77 | 3.82 | 5.85 | 674 | 16.38 | 5.4337 |
| 7.9 | 920 | 10.30 | 0.81 | 1.9 | 219 | 70.93 | 2.37 | 3.9 | 440 | 75.70 | 3.86 | 5.9 | 680 | 15.07 | 5.4742 |
| 7.95 | 926 | 11.42 | 0.85 | 1.95 | 225 | 72.19 | 2.41 | 3.95 | 446 | 74.58 | 3.90 | 5.95 | 686 | 13.81 | 5.5146 |
| 8 | 932 | 12.59 | 0.89 | 2 | 231 | 73.41 | 2.45 | 4 | 452 | 73.41 | 3.94 | 6 | 692 | 12.59 | 5.5551 |
| 0 | 0 | 12.59 | 0.89 | 2.05 | 237 | 74.58 | 2.49 | 4.05 | 458 | 72.19 | 3.98 | 6.05 | 698 | 11.42 | 5.5955 |
| 0.05 | 6 | 13.81 | 0.93 | 2.1 | 243 | 75.70 | 2.53 | 4.1 | 464 | 70.93 | 4.02 | 6.1 | 704 | 10.30 | 5.636 |
| 0.1 | 12 | 15.07 | 0.97 | 2.15 | 249 | 76.77 | 2.57 | 4.15 | 470 | 69.62 | 4.06 | 6.15 | 710 | 9.23 | 5.6764 |
| 0.15 | 18 | 16.38 | 1.01 | 2.2 | 255 | 77.79 | 2.61 | 4.2 | 476 | 68.27 | 4.10 | 6.2 | 716 | 8.21 | 5.7169 |
| 0.2 | 24 | 17.73 | 1.05 | 2.25 | 261 | 78.75 | 2.65 | 4.25 | 482 | 66.89 | 4.14 | 6.25 | 722 | 7.25 | 5.7573 |
| 0.25 | 30 | 19.11 | 1.09 | 2.3 | 267 | 79.66 | 2.69 | 4.3 | 488 | 65.47 | 4.18 | 6.3 | 728 | 6.34 | 5.7978 |
| 0.3 | 36 | 20.53 | 1.13 | 2.35 | 273 | 80.52 | 2.73 | 4.35 | 494 | 64.01 | 4.22 | 6.35 | 734 | 5.48 | 5.8382 |
| 0.35 | 42 | 21.99 | 1.17 | 2.4 | 279 | 81.31 | 2.77 | 4.4 | 500 | 62.52 | 4.26 | 6.4 | 740 | 4.69 | 5.8787 |
| 0.4 | 48 | 23.48 | 1.21 | 2.45 | 285 | 82.05 | 2.81 | 4.45 | 506 | 61.00 | 4.30 | 6.45 | 746 | 3.95 | 5.9191 |
| 0.45 | 54 | 25.00 | 1.25 | 2.5 | 291 | 82.73 | 2.85 | 4.5 | 512 | 59.46 | 4.34 | 6.5 | 752 | 3.27 | 5.9596 |
| 0.5 | 60 | 26.54 | 1.29 | 2.55 | 297 | 83.34 | 2.89 | 4.55 | 518 | 57.88 | 4.38 | 6.55 | 758 | 2.66 | 6 |
| 0.55 | 66 | 28.12 | 1.33 | 2.6 | 303 | 83.90 | 2.93 | 4.6 | 524 | 56.29 | 4.42 | 6.6 | 764 | 2.10 | 6.0405 |
| 0.6 | 72 | 29.71 | 1.38 | 2.65 | 309 | 84.39 | 2.97 | 4.65 | 530 | 54.67 | 4.46 | 6.65 | 770 | 1.61 | 6.0809 |
| 0.65 | 78 | 31.33 | 1.42 | 2.7 | 315 | 84.81 | 3.01 | 4.7 | 536 | 53.04 | 4.50 | 6.7 | 776 | 1.19 | 6.1214 |
| 0.7 | 84 | 32.96 | 1.46 | 2.75 | 321 | 85.17 | 3.05 | 4.75 | 542 | 51.39 | 4.54 | 6.75 | 782 | 0.83 | 6.1618 |
| 0.75 | 90 | 34.61 | 1.50 | 2.8 | 327 | 85.47 | 3.09 | 4.8 | 548 | 49.73 | 4.58 | 6.8 | 788 | 0.53 | 6.2023 |
| 0.8 | 96 | 36.27 | 1.54 | 2.85 | 333 | 85.70 | 3.13 | 4.85 | 554 | 48.05 | 4.62 | 6.85 | 794 | 0.30 | 6.2427 |
| 0.85 | 102 | 37.95 | 1.58 | | | | | | | | | | | | |

FIG. 5B

600

| 502 TIME | 504 RAW MOTOR PULSE | 506 POSITION | 508 CRANK ANGLE | 606 ds/ d(THETA) |
|---|---|---|---|---|
| [SECS] | COUNT | [INCH] | [RADIANS] | IN |
| 6.9 | 800 | 0.13 | 0.00 | |
| 6.95 | 806 | 0.03 | 0.04 | -1.64 |
| 7 | 812 | 0.00 | 0.08 | 0.00 |
| 7.05 | 818 | 0.03 | 0.12 | 1.64 |
| 7.1 | 824 | 0.13 | 0.16 | 3.27 |
| 7.15 | 830 | 0.30 | 0.20 | 4.91 |
| 7.2 | 836 | 0.53 | 0.24 | 6.53 |
| 7.25 | 842 | 0.83 | 0.28 | 8.14 |
| 7.3 | 848 | 1.19 | 0.32 | 9.74 |
| 7.35 | 854 | 1.61 | 0.36 | 11.33 |
| 7.4 | 860 | 2.10 | 0.40 | 12.90 |
| 7.45 | 866 | 2.66 | 0.44 | 14.45 |
| 7.5 | 872 | 3.27 | 0.49 | 15.97 |
| 7.55 | 878 | 3.95 | 0.53 | 17.47 |
| 7.6 | 884 | 4.69 | 0.57 | 18.95 |
| 7.65 | 890 | 5.48 | 0.61 | 20.39 |
| 7.7 | 896 | 6.34 | 0.65 | 21.81 |
| 7.75 | 902 | 7.25 | 0.69 | 23.19 |
| 7.8 | 908 | 8.21 | 0.73 | 24.53 |
| 7.85 | 914 | 9.23 | 0.77 | 25.84 |
| 7.9 | 920 | 10.30 | 0.81 | 27.10 |
| 7.95 | 926 | 11.42 | 0.85 | 28.33 |
| 8 | 932 | 12.59 | 0.89 | 29.51 |
| 0.05 | 6 | 13.81 | 0.93 | 30.65 |
| 0.1 | 12 | 15.07 | 0.97 | 31.74 |
| 0.15 | 18 | 16.38 | 1.01 | 32.78 |

608

610

FIG. 6A

| | | | | |
|---|---|---|---|---|
| 0.2 | 24 | 17.73 | 1.05 | 33.76 |
| 0.25 | 30 | 19.11 | 1.09 | 34.70 |
| 0.3 | 36 | 20.53 | 1.13 | 35.59 |
| 0.35 | 42 | 21.99 | 1.17 | 36.41 |
| 0.4 | 48 | 23.48 | 1.21 | 37.19 |
| 0.45 | 54 | 25.00 | 1.25 | 37.90 |
| 0.5 | 60 | 26.54 | 1.29 | 38.56 |
| 0.55 | 66 | 28.12 | 1.33 | 39.16 |
| 0.6 | 72 | 29.71 | 1.38 | 39.69 |
| 0.65 | 78 | 31.33 | 1.42 | 40.17 |
| 0.7 | 84 | 32.96 | 1.46 | 40.58 |
| 0.75 | 90 | 34.61 | 1.50 | 40.93 |
| 0.8 | 96 | 36.27 | 1.54 | 41.22 |
| 0.85 | 102 | 37.95 | 1.58 | |

FIG. 6B

METHODS AND APPARATUS TO DETERMINE OPERATING PARAMETERS OF A PUMPING UNIT FOR USE WITH WELLS

FIELD OF THE DISCLOSURE

This disclosure relates generally to hydrocarbon and/or fluid production and, more particularly, to methods and apparatus to determine operating parameters of a pumping unit for use with wells.

BACKGROUND

Pumping units are used to extract fluid (e.g., hydrocarbons) from a well. As the pumping unit cycles to extract the fluid from the well, different forces are imparted on the components of the pumping unit.

SUMMARY

An example method includes determining a first angle of a crank arm of a pumping unit and determining a first torque factor for the pumping unit. The first torque factor includes a rate of change in a position of a polished rod with respect to an angle of the crank arm of the pumping unit. The method includes, based on the first angle of the crank arm, the first torque factor, and a reference polished rod speed, determining a rate at which to operate a motor of the pumping unit to enable the polished rod to move at the reference polished rod speed.

An example method includes determining a first angle of a crank arm of a pumping unit and determining a first torque factor for the pumping unit. The first torque factor includes a rate of change in a position of the polished rod with respect to an angle of the crank arm. The method also includes determining a first load on the polished rod and comparing the first load to a reference load. The method includes, based on the comparison between the first and reference loads, determining a speed at which to operate the polished rod to enable the reference load on the polished rod to be substantially similar to a subsequently determined load on the polished rod.

An example apparatus includes a housing and a processor positioned in the housing. The processor is to determine a rate at which to operate a motor of a pumping unit to enable a load imparted on a polished rod of the pumping unit to be within a threshold of a reference load or to enable a speed of the polished rod to be within a threshold of a reference speed.

BRIEF DESCRIPTION OF THE DRAWINGS

FIGS. 4A and 4B show an example reference table generated during an example calibration process in accordance with the teachings of this disclosure.

FIGS. 5A and 5B show another example reference table generated using the examples disclosed herein.

FIGS. 6A and 6B show another example reference table generated using the examples disclosed herein.

The figures are not to scale. Wherever possible, the same reference numbers will be used throughout the drawing(s) and accompanying written description to refer to the same or like parts.

DETAILED DESCRIPTION

Figure 1:
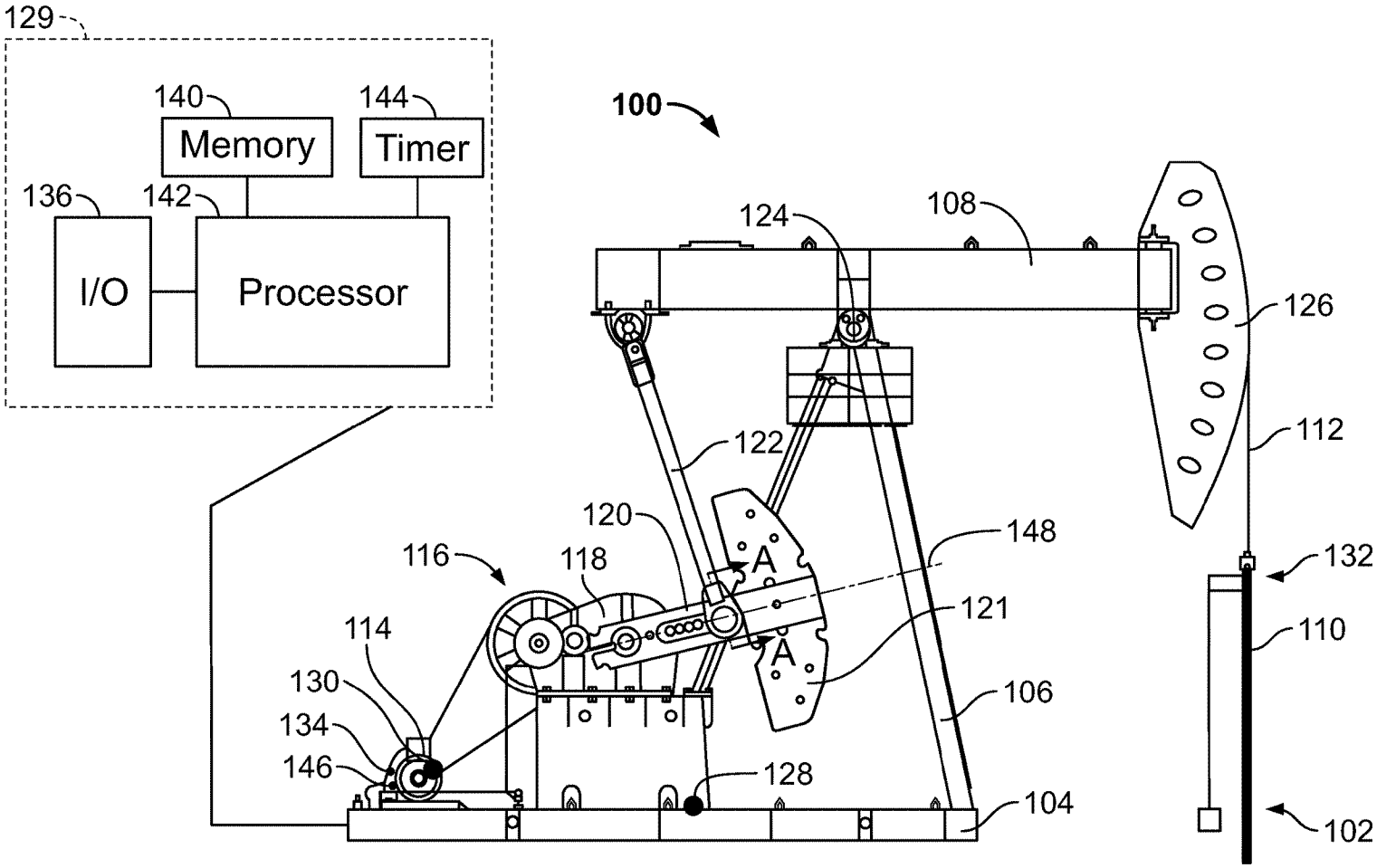
FIG. 1 is an example pumping unit for use with a well on which the examples disclosed herein can be implemented.

As a pumping unit of a well moves through a cycle, the downhole fluid imparts friction on the sucker rod string of the pumping unit. If the downhole fluid is, for example, a high viscosity oil, the friction imparted on the sucker rod string during its downstroke may be sufficient to cause the sucker rod string and the polished rod to move (e.g., fall) into a well at a slower rate than anticipated and separate from a carrier bar of the pumping unit. Polished rod/carrier bar separation may be referred to as rod float. In some examples, separating the polished rod and the carrier unit may overload the gearbox and/or shock load the pumping unit and/or the sucker rod string. In some examples, rod float may be detected by higher motor torques because the motor lifts the counterweight of the pumping unit without the assistance of the load of the polished rod when the polished rod and the carrier unit separate. In some examples, rod float may be detected if the measured polished rod load falls below a predetermined threshold.

Some known methods have attempted to address rod float by reducing the motor speed when rod float is detected. However, slowing the motor speed when rod float is detected does not in itself prevent rod float because the polished rod may be moving through a high speed section of its stroke. In the high rod speed section, the mechanical design of the pumping unit and the sinusoidal relationship between the carrier bar speed and the motor/crank arm angular velocity may cause the carrier bar to continue to accelerate downward and separate from the sucker rod string.

In contrast to some known approaches, the examples disclosed herein address rod float by automatically controlling the speed and/or load on the polished rod when, for example, rod float is detected without adversely affecting the motor, the pumping unit, the polished rod and/or the pump. A substantially constant polished rod speed on the upstroke enables peak loads to be reduced. A substantially constant polished rod speed on the downstroke enables minimum loads to be increased. A substantially constant polished rod load on the downstroke enables the pumping unit to be operated at a maximum overall cycle speed while also substantially reducing speed-related operational issues such as, for example, rod float. In some examples, reducing the range between the minimum and maximum loads and/or speeds reduces the likelihood of fatigue failures on the polished rod.

In some examples, to substantially prevent rod float, the load on the polished rod is maintained at or above a predetermined value where rod float does not commonly occur. In such examples, the polished rod load is monitored and/or controlled by controlling the speed of the polished rod. In some examples, the velocity of the polished rod is maintained substantially constant and below a speed where rod float occurs by determining the velocity of the carrier bar and adjusting and/or controlling the motor speed (e.g., variable drive speed).

FIG. 1 shows an example crank arm balanced pumping unit and/or pumping unit 100 that can be used to produce oil from an oil well 102. The pumping unit 100 includes a base 104, a Sampson post 106 and a walking beam 108. The walking beam 108 may be used to reciprocate a polished rod 110 relative to the oil well 102 via a bridle 112.

The pumping unit 100 includes a motor or engine 114 that drives a belt and sheave system 116 to rotate a gear box 118 and, in turn, rotate a crank arm 120 and a counterweight 121. A pitman 122 is coupled between the crank arm 120 and the walking beam 108 such that rotation of the crank arm 120 moves the pitman 122 and the walking beam 108. As the walking beam 108 pivots about a pivot point and/or saddle bearing 124, the walking beam 108 moves a horse head 126 and the polished rod 110.

To detect when the crank arm 120 completes a cycle and/or passes a particular angular position, a first sensor 128 is coupled adjacent to the crank arm 120. To detect and/or monitor a number of revolutions of the motor 114, a second sensor 130 is coupled adjacent the motor 114. A third sensor (e.g., a string potentiometer, a linear displacement sensor using radar, laser, etc.) 132 is coupled to the pumping unit 100 and is used in combination with the first and second sensors (e.g., proximity sensors) 128, 130 to calibrate a rod pump controller and/or apparatus 129 in accordance with the teachings of this disclosure. In contrast to some known pumping units that rely on measuring the pumping unit and determining a crank arm/polished rod offset, the example apparatus 129 is calibrated by measuring directly the position of the polished rod 110 and the rotation of the motor 114 throughout a cycle of the crank arm 120.

In some examples, to calibrate the apparatus 129 of FIG. 1, the first sensor 128 detects the completion of a cycle of the crank arm 120, the second sensor 130 detects one or more targets 134 coupled to the motor 114 and/or a shaft of the motor 114 as the motor 114 rotates and the third sensor 132 measures directly the position of the polished rod 110 throughout its stroke. Data obtained from the first, second and third sensors 128, 130 and 132 are received by an input/out (I/O) device 136 of the apparatus 129 and stored in a memory 140 that is accessible by a processor 142 positioned within a housing of the apparatus 129. For example, during the calibration process, the processor 142 iteratively receives and/or substantially simultaneously receives (e.g., every 50-milliseconds, every 5-seconds, between about 5-seconds and 60-seconds) a crank pulse count and/or pulse from the first sensor 128, a motor pulse count versus time and/or a pulse from the second sensor 130 and the position of the polished rod 110 versus time from the third sensor 132. In some examples, a timer 144 is used by the processor 142 and/or the first, second and/or third sensors 128, 130 and/or 132 to determine a sampling period and/or to determine when to request, send and/or receive data (e.g., measured parameter values) from the first, second and third sensors 128, 130 and 132. Additionally, in some examples, an input (e.g., sensor input, operator input) may be received by the I/O device 136 indicating when the crank arm 120 is vertical. The counterbalance torque may be at its minimum (e.g., approximately zero) when the crank arm 120 is vertical. Based on the input, the motor pulse count from a point in the cycle of the pumping unit 100 to the vertical position may be determined.

In some examples, the processor 142 generates a reference and/or calibration table 400 (FIGS. 4A and 4B) showing the relationship(s) between these measured parameter values (e.g., time, motor pulse count, and polished rod position) for a complete cycle(s) of the pumping unit 100 based on the position of the polished rod 110 versus time and the motor pulse count versus time between two consecutive crank pulse counts (e.g., a revolution of the crank arm 120). In some examples, time may be measured in seconds and the position of the polished rod 110 may be measured in inches.

Once the calibration process has completed and the corresponding reference table 400 has been generated, the determined position data (e.g., position of the polished rod 110 versus time data) is saved in the memory 140 and/or used by the processor 142 to generate a dynamometer card such as, for example, a rod pump dynamometer card, a surface dynamometer card, a pump dynamometer card, etc. The dynamometer cards may be used to identify the load, F, on the polished rod 110, for example. Additionally or alternatively, the values included in the reference table 400 may be used to determine the number of motors pulses per crank arm 120 revolution.

As shown in the reference table 500 of FIGS. 5A and 5B, the values of the reference table 400 of FIGS. 4A and 4B may be adjusted such that the measurements are based on a vertical position of the crank arm 120 and scaled to be associated with crank arm 120 angular displacements (i.e., crank angle). In some examples, Equation 1 may be used to determine the crank angle based on values included in the reference table 400, where MP corresponds to the number of motor pules detected by the second sensor 130, MPPCZ corresponds to the number of motor pules detected by the second sensor 130 when the crank arm 120 is zero and MPPCR corresponds to the number of motor pules detected by the second sensor 130 during one revolution of the crank arm 120.

$$\text{Crank Angle} = \frac{2\pi(MP - MPPCZ)}{MPPCR} \qquad \text{Equation 1}$$

Equation 2 may be used to determine the torque created by the polished rod load, $T_{PRL}(\theta)$, when the crank arm 120 is at an angle, θ, where F corresponds to the polished rod load and $$\frac{ds(\theta)}{d\theta}$$

corresponds to the rate of change in the position of the polished rod 110 with respect to the change in the angle of the crank arm 120 (e.g., torque factor). Equation 3 is a backward derivative calculation that may be used to determine the torque factor, TF, as represented in FIGS. 6A and 6B, where PRP[i] corresponds to the first position of the polished rod 110, PRP[i−1] corresponds to a previous position of the polished rod 110, crank angle[i] corresponds to a first angle of the crank arm 120 and crank angle[i−1] corresponds to a previous angle of the crank arm 120.

$$T_{PRL}(\theta) = F * \frac{ds(\theta)}{d\theta} \qquad \text{Equation 2}$$

-continued $$TF = \frac{PRP[i] - PRP[i-1]}{\text{crank angle}[i] - \text{crank angle}[i-1]} \quad \text{Equation 3}$$

Equation 4 may be used to determine an input (e.g., frequency, Hertz) to a fourth sensor 146 and/or the motor 114 to maintain the velocity of the polished rod 110 substantially constant, within a threshold of a particular speed and/or below a speed where rod float occurs. In some examples, the speed threshold is between about 0.5 inches per second and 20.0 inches per second. However, the speed of the polished rod 110 may vary outside of this range. The input to the fourth sensor 146 and/or the motor 114 may be determined by determining the velocity of the carrier bar and adjusting and/or controlling the motor speed (e.g., variable drive speed). Referring to Equation 4, HzCMD relates to the target input to the fourth sensor 146, NPHZ relates to the rated frequency of the motor 114 from the nameplate of the motor 114 and NPRPM relates to the full load RPM of the motor from the nameplate of the motor 114. Continuing to refer to Equation 4, MPpCR relates to the number of motor pulses received between two consecutive pulses of the crank arm 120, MPpMR relates to the number of motor pulse signals created per revolution of the motor and PRS corresponds to the desired speed of the polished rod 110.

$$HzCMD = \left(\frac{60}{2\pi}\right) * \left(\frac{NPHZ}{NPRPM}\right) * \left(\frac{MPpCR}{MPpMR}\right) * \left(\frac{PRS}{TF}\right) \quad \text{Equation 4}$$

Figure 2:
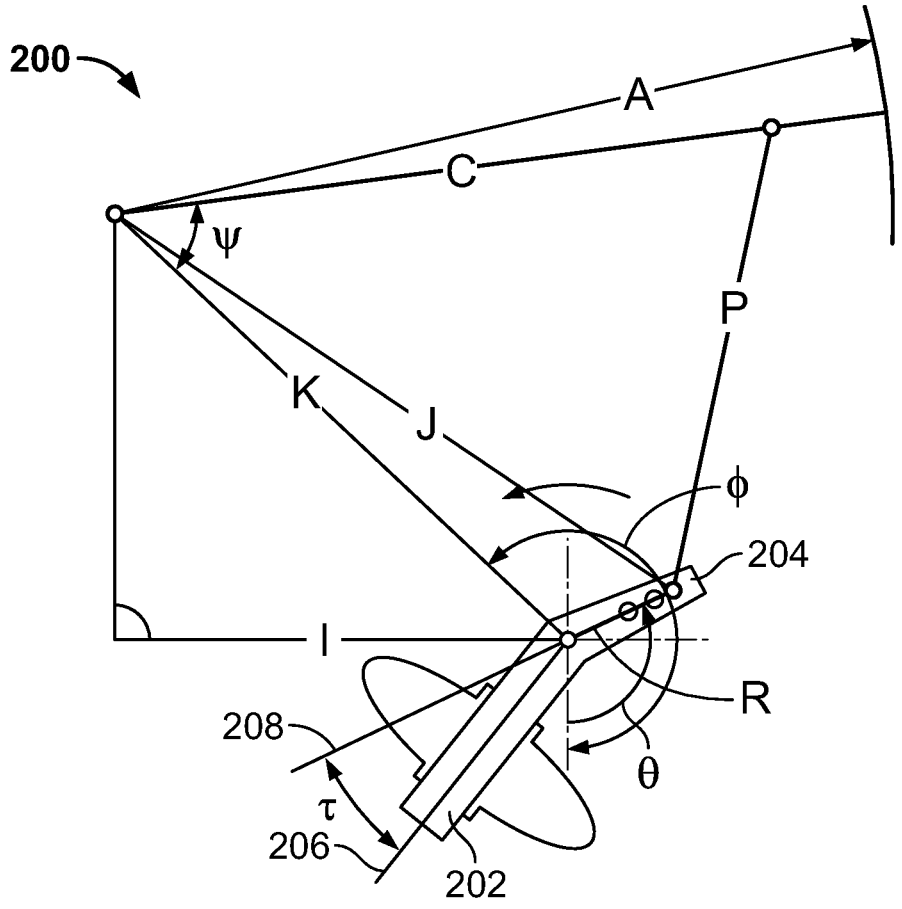
FIG. 2 is another example pumping unit for use with a well on which the examples disclosed herein can be implemented.

FIG. 2 shows a Mark II type pumping unit and/or pumping unit 200 that can be used to implement the examples the disclosed herein. In contrast to the crank arm balanced pumping unit 100 of FIG. 1 in which the pins of the crank arm 120 and the counterweight 121 share a common axis 148, the Mark II type pumping unit 200 includes a counterweight arm 202 and a pin arm 204 having offset axes 206 and 208. The offset axes 206 and 208 provide the pumping unit 200 a positive phase angle, τ.

Figure 3:
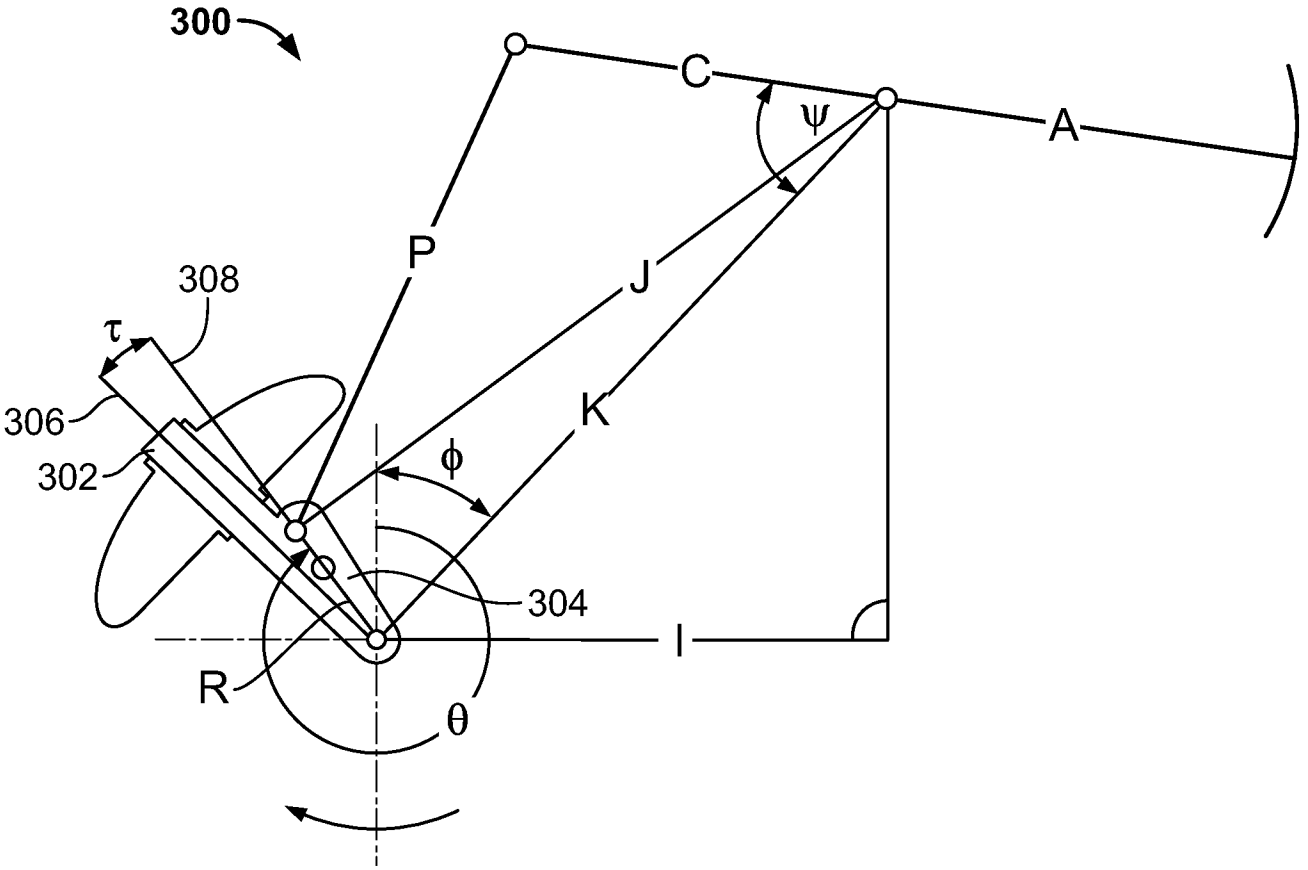
FIG. 3 is another example pumping unit for use with a well on which the examples disclosed herein can be implemented.

FIG. 3 shows an advanced geometry pumping unit and/or pumping unit 300 that can be used to implement the examples the disclosed herein. In contrast to the crank arm balanced pumping unit 100 of FIG. 1 in which the pins of the crank arm 120 and the counterweight 121 share the common axis 148, the advance geometry pumping unit 300 includes a counterweight arm 302 and a pin arm 304 having offset axes 306 and 308. The offset axes 306 and 308 provide the pumping unit 300 a negative phase angle, τ.

FIGS. 4A and 4B show the example reference table 400 that can be generated in connection with and/or used to implement the examples disclosed herein. The example reference table 400 includes first columns 402 corresponding to time received from and/or determined by the timer 144, second columns 404 corresponding to the pulse count of the motor 114 received from and/or determined by the second sensor 130 and third columns 406 corresponding to the position of the polished rod 110 received from and/or determined by the third sensor 132. In some examples, the data included in the reference table 400 relates to a single revolution of the crank arm 120.

FIGS. 5A and 5B show the example reference table 500 that can be generated in connection with and/or used to implement the examples disclosed herein. In some examples, the reference table 500 is generated by adjusting the values of the reference table 400 of FIGS. 4A and 4B such that the measurements are based on a vertical position of the crank arm 120 and scaled to be associated with crank angular displacements (i.e., crank angle in radians). The example reference table 500 includes first columns 502 corresponding to time received from and/or determined by the timer 144, second columns 504 corresponding to the pulse count of the motor 114 received from and/or determined by the second sensor 130, third columns 506 corresponding to the position of the polished rod 110 received from and/or determined by the third sensor 132 and fourth columns 508 corresponding to the crank angle.

FIGS. 6A and 6B show the example reference table 600 that can be generated in connection with and/or used to implement the examples disclosed herein. In some examples, the reference table 600 is generated using a backward difference calculation shown in Equation 3 to determine the torque factor, TF. The example reference table 600 includes the first column 502 corresponding to time received from and/or determined by the timer 144, the second column 504 corresponding to the pulse count of the motor 114 received from and/or determined by the second sensor 130, the third column 506 corresponding to the position of the polished rod 110 received from and/or determined by the third sensor 132 and the fourth column 508 corresponding to the crank angle. The reference table 600 also includes a fifth column 606 corresponding to the torque factor, TF.

While an example manner of implementing the apparatus 129 is illustrated in FIG. 1, one or more of the elements, processes and/or devices illustrated in FIG. 1 may be combined, divided, re-arranged, omitted, eliminated and/or implemented in any other way. Further, the I/O device 136, the memory 140, the processor 142 and/or, more generally, the example apparatus 129 of FIG. 1 may be implemented by hardware, software, firmware and/or any combination of hardware, software and/or firmware. Thus, for example, any of the I/O device 136, the memory 140, the processor 142, the timer 144 and/or, more generally, the example apparatus 129 of FIG. 1 could be implemented by one or more analog or digital circuit(s), logic circuits, programmable processor(s), application specific integrated circuit(s) (ASIC(s)), programmable logic device(s) (PLD(s)) and/or field programmable logic device(s) (FPLD(s)). When reading any of the apparatus or system claims of this patent to cover a purely software and/or firmware implementation, at least one of the example I/O device 136, the memory 140, the processor 142, the timer 144 and/or, more generally, the example apparatus 129 of FIG. 1 is/are hereby expressly defined to include a tangible computer readable storage device or storage disk such as a memory, a digital versatile disk (DVD), a compact disk (CD), a Blu-ray disk, etc. storing the software and/or firmware. Further still, the example apparatus 129 of FIG. 1 may include one or more elements, processes and/or devices in addition to, or instead of, those illustrated in FIG. 1, and/or may include more than one of any or all of the illustrated elements, processes and devices. While FIG. 1 depicts a conventional crank-balanced pumping unit, the examples disclosed herein can be implemented in connection with any other pumping unit. For example, the example apparatus 129 and/or the sensors 128, 130, 132, and/or 146 may be implemented on the pumping unit 200 of FIG. 2 and/or the pumping unit 300 of FIG. 3.

Flowcharts representative of example methods for implementing the apparatus 129 of FIG. 1 are shown in FIGS. 7-11. In this example, the methods of FIGS. 7-11 may be implemented by machine readable instructions that comprise a program for execution by a processor such as the processor 1212 shown in the example processor platform 1200 discussed below in connection with FIG. 12. The program may be embodied in software stored on a tangible computer readable storage medium such as a CD-ROM, a floppy disk, a hard drive, a digital versatile disk (DVD), a Blu-ray disk, or a memory associated with the processor 1212, but the entire program and/or parts thereof could alternatively be executed by a device other than the processor 1212 and/or embodied in firmware or dedicated hardware. Further, although the example program is described with reference to the flowcharts illustrated in FIGS. 7-11 many other methods of implementing the example apparatus 129 may alternatively be used. For example, the order of execution of the blocks may be changed, and/or some of the blocks described may be changed, eliminated, or combined.

As mentioned above, the example methods of FIGS. 7-11 may be implemented using coded instructions (e.g., computer and/or machine readable instructions) stored on a tangible computer readable storage medium such as a hard disk drive, a flash memory, a read-only memory (ROM), a compact disk (CD), a digital versatile disk (DVD), a cache, a random-access memory (RAM) and/or any other storage device or storage disk in which information is stored for any duration (e.g., for extended time periods, permanently, for brief instances, for temporarily buffering, and/or for caching of the information). As used herein, the term tangible computer readable storage medium is expressly defined to include any type of computer readable storage device and/or storage disk and to exclude propagating signals and to exclude transmission media. As used herein, "tangible computer readable storage medium" and "tangible machine readable storage medium" are used interchangeably. Additionally or alternatively, the example methods of FIGS. 7-11 may be implemented using coded instructions (e.g., computer and/or machine readable instructions) stored on a non-transitory computer and/or machine readable medium such as a hard disk drive, a flash memory, a read-only memory, a compact disk, a digital versatile disk, a cache, a random-access memory and/or any other storage device or storage disk in which information is stored for any duration (e.g., for extended time periods, permanently, for brief instances, for temporarily buffering, and/or for caching of the information). As used herein, the term non-transitory computer readable medium is expressly defined to include any type of computer readable storage device and/or storage disk and to exclude propagating signals and to exclude transmission media. As used herein, when the phrase "at least" is used as the transition term in a preamble of a claim, it is open-ended in the same manner as the term "comprising" is open ended.

Figure 7:
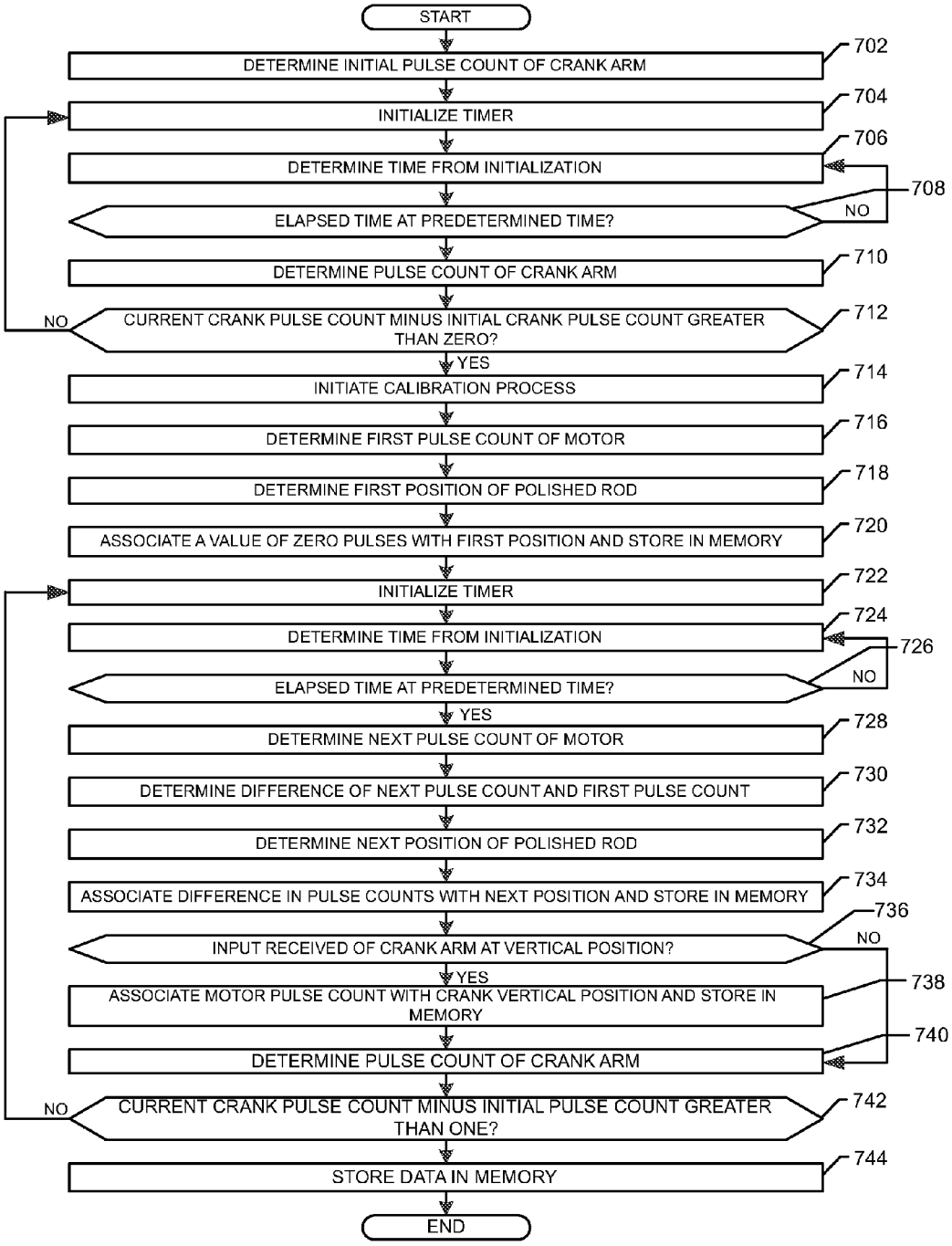
FIGS. 7-11 are flowcharts representative of example methods that may be used to implement the example pumping units of FIGS. 1-3.

The method of FIG. 7 may be used to generate the reference table 400 and begins in a calibration preparation mode that includes determining an initial pulse count of the crank arm 120 (block 702). At block 704, the processor 142 initiates and/or initializes the timer 144 (block 704). At block 706, the processor 142 determines, via the timer 144, the amount of time elapsed since the timer 144 was initialized (block 706). At block 708, the processor 142 determines if the elapsed time is at or after a predetermined time such as, for example, fifty milliseconds (block 708). The timer 144 may be used to set a sampling period and/or to substantially ensure data is obtained from the first, second and/or third sensors 128, 130, 132 at equal frequencies. If the processor 142 determines that the elapsed time is at or after the predetermined time, based on data from the first sensor 128, the processor 142 determines the pulse count of the crank arm 120 (block 710). At block 712, the processor 142 determines, based on data from the first sensor 128, if the difference between the current pulse count of the crank arm 120 and the initial pulse count of the crank arm 120 is greater than zero (block 712). In some examples, the pulse count of the crank arm 120 changes from zero to one once a cycle of the crank arm 120 has completed. In examples in which the pulse count begins at one, the processor 142 determines if the pulse count of the crank arm 120 has changed.

If the pulse count difference at block 712 is equal to zero, based on data from the first sensor 128, the processor 142 again initializes the timer 144 (block 704). However, if the pulse count difference at block 712 is greater than zero, the calibration process is initiated (block 714). At block 716, the second sensor 130 determines a first pulse count of the motor 114 (block 716). In other examples, immediately after the calibration process is initiated, the pulse count of the motor 114 is not obtained. At block 718, based on data from the third sensor 132, the processor 142 determines a first position of the polished rod 110 (block 718). The processor 142 then associates a value of zero pulses with the first position of the polished rod 110 and stores this data in the memory 140 (block 720). For example, the pulse count may be stored in a first entry 408 of the second column 404 of the reference table 400 and the first position of the polished rod 110 may be stored in a first entry 410 of the third column 406 of the reference table 400.

At block 722, the processor 142 again initiates and/or initializes the timer 144 (block 722). At block 724, the processor 142 determines, via the timer 144, the amount of time elapsed since the timer 144 was initialized (block 724). At block 726, the processor 142 determines if the elapsed time is at or after a predetermined time such as, for example, fifty milliseconds (block 726). If the processor 142 determines that the elapsed time is at or after the predetermined time, based on data from the second sensor 130, the processor 142 determines a second and/or next pulse count of the motor 114 (block 728).

At block 730, the processor 142 determines the difference between the second and/or next pulse count and the first pulse count (block 730). At block 732, based on data from the third sensor 200, the processor 142 determines a second and/or next position of the polished rod 110 (block 732). At block 734, the processor 142 associates the difference between the first and second pulse counts with the second position and/or next position of the polished rod 110 and stores the data in the memory 140. For example, the pulse count difference may be stored in a second entry 412 of the second column 404 of the reference table 400 and the second position of the polished rod 110 may be stored in a second entry 414 of the third column 406 of the reference table 400. At block 736, the processor 142 determines if an input associated with the crank arm 120 being in a vertical and/or a zero position has been received (block 736). In some examples, the input may be an input received from an operator and/or a sensor that detects when the crank arm 120 is at the vertical and/or zero position. If an input is received regarding the crank arm 120 being in the vertical and/or zero position, the processor 142 associates the second or next pulse count with the crank arm 120 being in the vertical and/or zero position and stores this information in the memory 140 (block 738).

At block 740, based on data from the first sensor 128, the processor 142 determines the pulse count of the crank arm 120 (block 740). At block 742, the processor 142 determines if the difference between the current pulse count of the crank arm 120 and the initial pulse count of the crank arm 120 is greater than one (block 742). In some examples, the pulse count of the crank arm 120 changes if the crank arm 120 has completed a cycle. At block 744, the collected data, the reference table 400 and/or the processed data are stored in the memory 140 (block 744). The reference table 400 can be used in combination with data from the first and/or second sensors 128, 130 to determine the position of the polished rod 110 when the pumping unit 100 operates continuously. In some examples, the data included in the reference table 400 may be used to generate a dynamometer card that identifies the load, F, on the polished rod 110, for example. Additionally, the generated table 400 can be used to determine the net torque, TF, a rate at which to operate the motor 114, crank arm 120 angles, etc.

Figure 8:
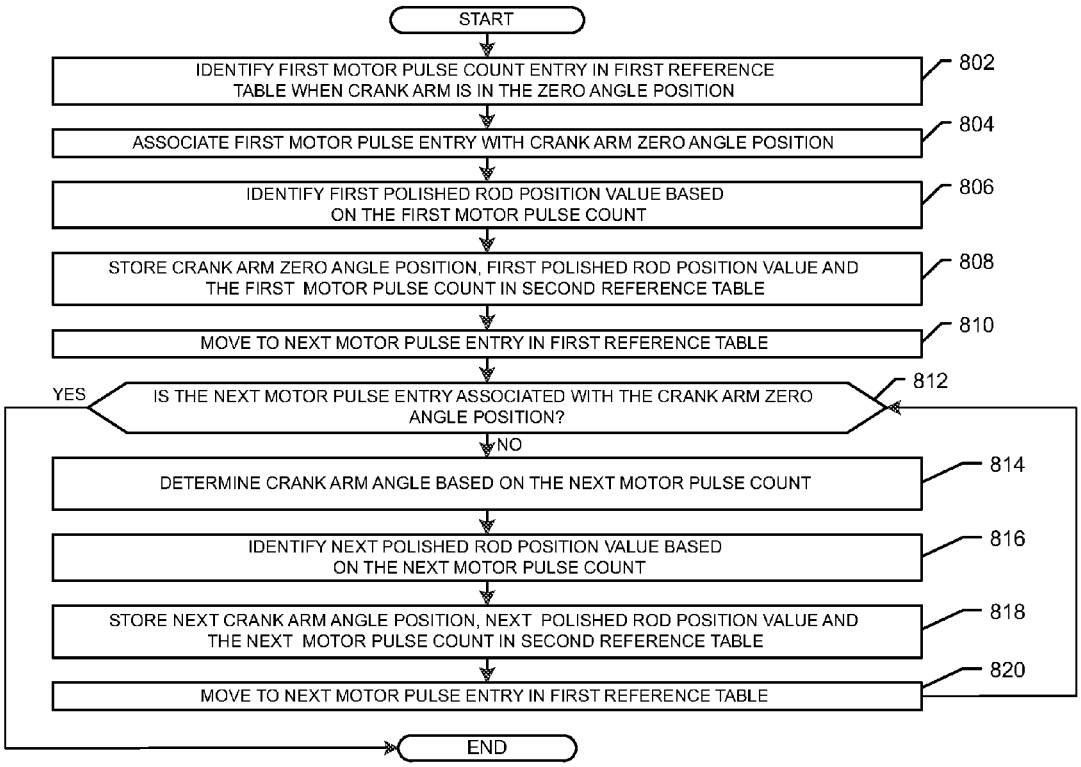

The method of FIG. 8 may be used to generate the reference table 500 and begins by the processor 142 identifying a first motor pulse entry in the reference table 400 that is associated with the crank arm 120 being in the vertical and/or zero angle position (block 802). The crank arm 120 may be associated with being in the vertical and/or zero position based on an input received by the processor 142. The input may be received from a sensor and/or an operator. In the reference table 400 of FIGS. 4A and 4B, the crank arm 120 was identified as being in the zero angle position (e.g., vertical position) when the motor pulse count is at 800 at entry 416.

At block 804, the processor 142 associates the first motor pulse count entry with the crank arm 120 angle zero position (block 804). The processor 142 also identifies the first polished rod 110 position at entry 417 that is associated with the first motor pulse count (block 806). At block 808, the processor 142 stores the crank arm 120 zero position at entry 510, the first polished rod 110 position at entry 512 and the first motor pulse count at entry 514 in the second reference table 500 (block 808).

At block 810, the processor 142 moves to the next motor pulse entry in the first reference table 400 (block 810). For example, if the next motor pulse entry is immediately after the first motor pulse entry, the processor 142 will move from entry 416 to entry 418. The processor 142 then determines if the next motor pulse entry is associated with the crank arm 120 zero angle position (block 812). In some examples, the next motor pulse entry is associated with the crank arm 120 zero angle position based on the crank arm 120 returning to the zero angle position after a full cycle. If the next motor pulse entry is associated with the crank arm 120 zero angle position, the method of FIG. 8 ends. However, if the next motor pulse entry is not associated with the crank arm 120 zero angle position, control moves to block 814.

At block 814, the processor determines the angle of the crank arm 120 based on the next motor pulse count entry (block 814). If the next motor pulse count entry is the first entry 408 in the reference table 400, the processor 142 may use Equation 4 to determine the angle of the crank arm 120. If the next motor pulse count entry is not the first entry 408 in the reference table 400, the processor 142 may use Equation 5 to determine the angle of the crank arm 120.

$$\text{Crank Angle} = 2\pi\frac{\text{motor pulses} + \text{motor pulses per crank stroke} - \text{motor pulses at crank arm zero position}}{\text{motor pulses per crank stroke}} \quad \text{Equation 4}$$

-continued $$\text{Crank Angle} = 2\pi\frac{\text{motor pulses} - \text{motor pulses at crank arm zero position}}{\text{motor pulses per crank stroke}} \quad \text{Equation 5}$$

The processor 142 also identifies the next polished rod 110 position associated with the next motor pulse count (block 816). At block 818, the processor 142 stores the crank arm 120 next position at, for example, entry 516, the next polished rod 110 position at, for example, entry 518 and the next motor pulse count at, for example, entry 520 in the second reference table 500 (block 818). At block 820, the processor 142 moves to the next motor pulse entry in the first reference table 400 (block 820). For example, if the next motor pulse entry is immediately after the second motor pulse entry, the processor 142 moves from entry 412 to entry 420.

Figure 9:
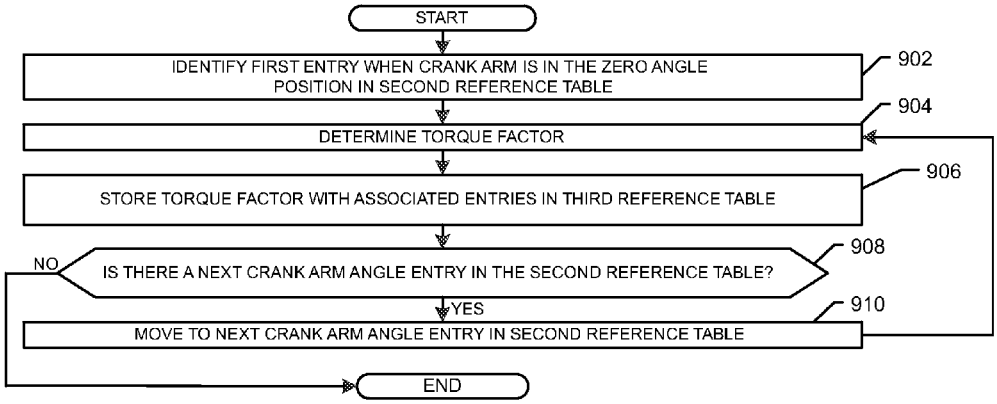

The method of FIG. 9 may be used to generate the reference table 500 and begins by the processor 142 identifying the first entry 608 in the reference table 500 when the crank arm 120 is in the vertical and/or zero angle position (block 902). At block 904, a torque factor is determined based on the associated crank arm 120 angle (block 904). In some examples, a backward difference approximation as shown in Equation 3 may be used to determine the torque factor, TF. The processor 142 then stores the TF in the associated entry in the fifth column 606 (block 906).

The processor 142 then determines if the reference table 500 includes another crank arm 120 angle entry (block 908). For example, if the there are no more crank arm 120 angle entries (e.g., there are no subsequent crank arm 120 angle entries) the method of FIG. 9 ends. However, if the next crank arm 120 angle entry is at entry 610, for example, the processor 142 then moves to the next crank arm 120 angle entry in the second reference table 500 and (block 910).

Figure 10:
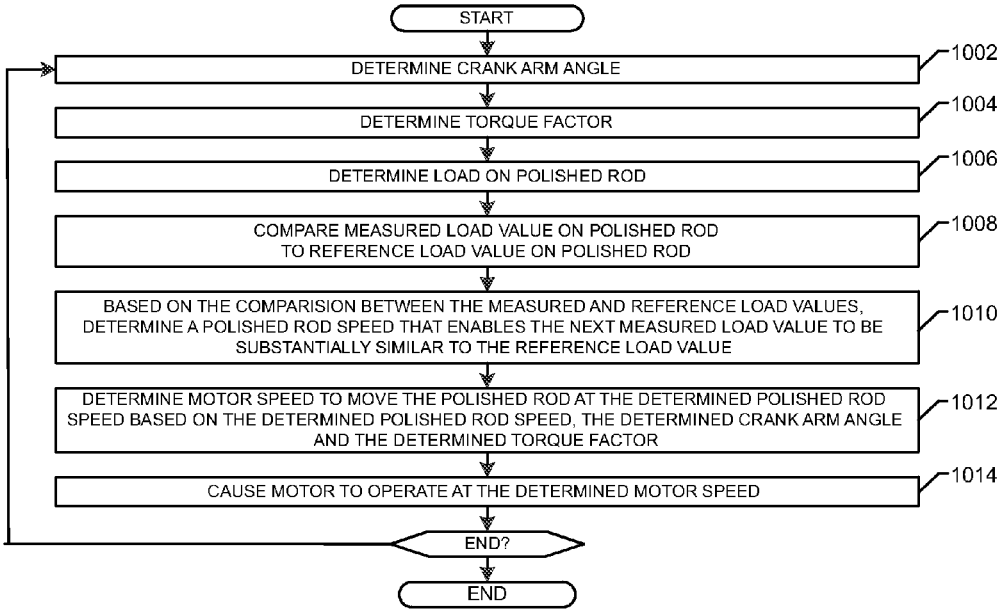

The method of FIG. 10 may be used to cause the pumping unit 100 to operate such that a threshold load (e.g., a minimum load, a maximum load and/or a particular load) is imparted on the polished rod 110. In some examples, the threshold load is between about 100 pounds to 50,000 pounds. However, the load imparted on the polished rod 110 may vary outside of this range. The method of FIG. 10 begins by the processor 142 determining the angular position of the crank arm 120 (block 1002). In some examples, the angular position of the crank arm 120 angle is determined by monitoring the motor 114 pulses and using the reference table 400 of FIGS. 4A and 4B and/or the reference table 500 of FIGS. 5A and 5B to determine the angular position of the crank arm 120. In some examples, the processor 142 may interpolate between the entries. The processor 142 then determines the associated torque factor using, for example, data in one or more of the reference tables 400, 500 and/or 600 (block 1004). In some cases, the processor 142 may interpolate between the entries. In other examples, the processor 142 determines the associated torque factor, TF, using, for example, Equation 3 and the polished rod 110 position at the first and second times and the crank arm 120 angle at the first and second times.

At block 1006, the processor 142 determines a load on the polished rod 110 (block 1006). The load on the polished rod may be determined using a sensor attached to, for example, the polished rod 110 and/or a dynometer card generated based on the reference table 400, for example. The determined load on the polished rod 110 is then compared to a reference polished rod 110 load to determine, for example, a polished rod 110 speed to attain and/or be substantially similar to the reference load value (blocks 1008, 1010). As used herein, the polished rod 110 load is substantially similar to the reference load value if there is not a noticeable and/or significant difference between the loads. At block 1012, based on the determined polished rod 110 speed, the determined crank arm 120 angle and the determined torque factor, the processor 142 determines a speed to operate the motor 114 and/or the fourth sensor 146 to enable the polished rod 110 to move at the determined polished rod 110 speed (block 1012). The processor 142 then causes the motor 114 and/or the fourth sensor 146 to operate at the determined speed (block 1014).

Figure 11:
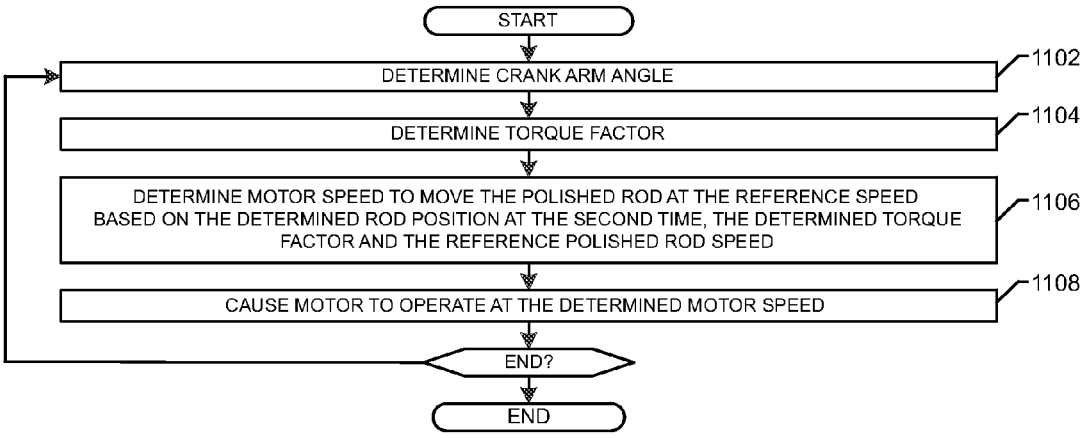

The method of FIG. 11 may be used to cause the pumping unit 100 to operate such that the polished rod 110 moves at a particular speed and/or within a threshold of a particular speed. The method of FIG. 10 begins by the processor 142 determining the angular position of the crank arm 120 (block 1102). In some examples, the angular position of the crank arm 120 angle is determined by monitoring the motor 114 pulses and using the reference table 400 of FIGS. 4A and 4B and/or the reference table 500 of FIGS. 5A and 5B to determine the angular position of the crank arm 120. In some examples, the processor 142 may interpolate between the entries. The processor 142 then determines the associated torque factor using, for example, data in one or more of the reference tables 400, 500 and/or 600 (block 1104). In some cases, the processor 142 may interpolate between the entries. In other examples, the processor 142 determines the associated torque factor, TF, using, for example, Equation 3 and the polished rod 110 position at the first and second times and the crank arm 120 angle at the first and second times.

At block 1106, based on the determined crank arm 120 angle, the determined torque factor and the reference polished rod 110 speed, the processor 142 determines a speed to operate the motor 114 and/or the fourth sensor 146 to enable the polished rod 110 to move at and/or substantially similar to the determined polished rod 110 speed (block 1108). As used herein, the polished rod 110 moves at a speed substantially similar to the determined polished rod 100 speed if there is not a noticeable and/or significant difference between the speeds. The processor 142 causes the motor 114 and/or the fourth sensor 146 to operate at the determined speed (block 1110).

Figure 12:
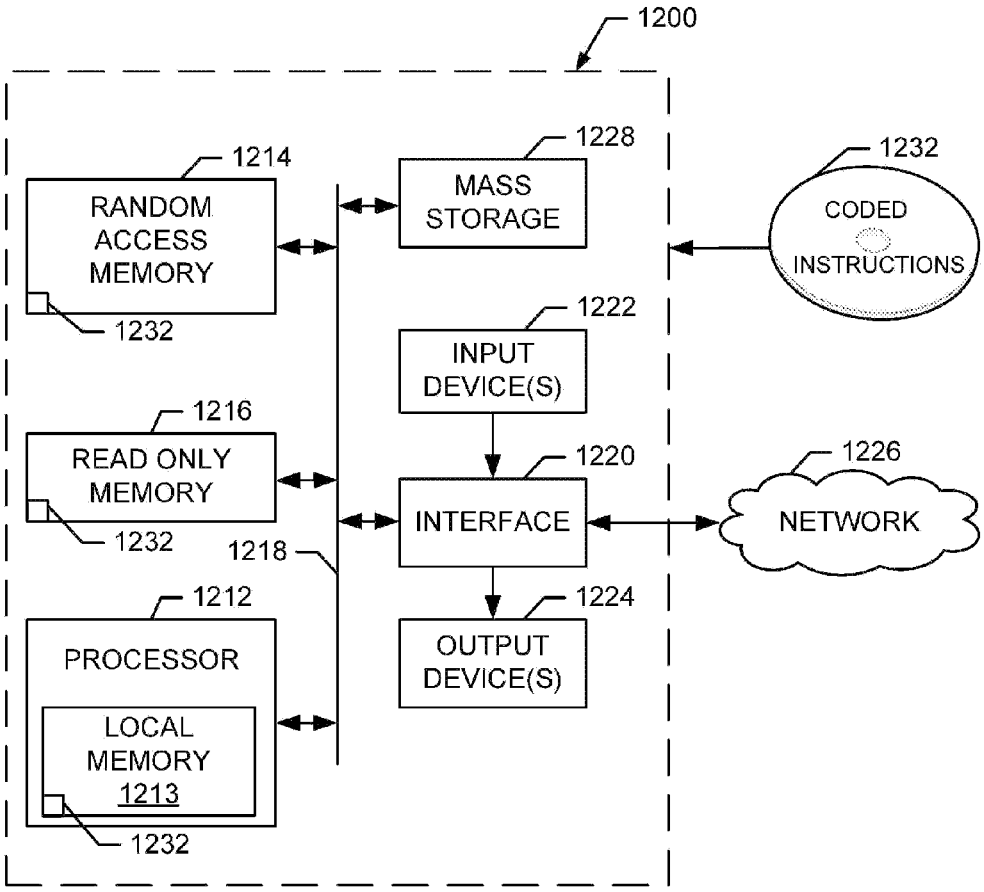
FIG. 12 is a processor platform to implement the methods of FIGS. 7-11 and/or the apparatus of FIGS. 1-3.

FIG. 12 is a block diagram of an example processor platform 1100 capable of executing the instructions to implement the methods of FIGS. 7-11 to implement the apparatus 129 of FIG. 1. The processor platform 1100 can be, for example, a server, a personal computer, a mobile device (e.g., a cell phone, a smart phone, a tablet such as an iPad™), a personal digital assistant (PDA), an Internet appliance, or any other type of computing device.

The processor platform 1200 of the illustrated example includes a processor 1212. The processor 1212 of the illustrated example is hardware. For example, the processor 1212 can be implemented by one or more integrated circuits, logic circuits, microprocessors or controllers from any desired family or manufacturer.

The processor 1212 of the illustrated example includes a local memory 1213 (e.g., a cache). The processor 1212 of the illustrated example is in communication with a main memory including a volatile memory 1214 and a non-volatile memory 1216 via a bus 1218. The volatile memory 1214 may be implemented by Synchronous Dynamic Random Access Memory (SDRAM), Dynamic Random Access Memory (DRAM), RAMBUS Dynamic Random Access Memory (RDRAM) and/or any other type of random access memory device. The non-volatile memory 1216 may be implemented by flash memory and/or any other desired type of memory device. Access to the main memory 1214, 1216 is controlled by a memory controller.

The processor platform 1200 of the illustrated example also includes an interface circuit 1220. The interface circuit 1220 may be implemented by any type of interface standard, such as an Ethernet interface, a universal serial bus (USB), and/or a PCI express interface.

In the illustrated example, one or more input devices 1222 are connected to the interface circuit 1220. The input device(s) 1222 permit(s) a user to enter data and commands into the processor 1212. The input device(s) can be implemented by, for example, an audio sensor, a microphone, a keyboard, a button, a mouse, a touchscreen, a track-pad, a trackball, isopoint and/or a voice recognition system.

One or more output devices 1224 are also connected to the interface circuit 1220 of the illustrated example. The output devices 1224 can be implemented, for example, by display devices (e.g., a light emitting diode (LED), an organic light emitting diode (OLED), a liquid crystal display, a cathode ray tube display (CRT), a touchscreen, a tactile output device, a light emitting diode (LED), a printer and/or speakers). The interface circuit 1220 of the illustrated example, thus, typically includes a graphics driver card, a graphics driver chip or a graphics driver processor.

The interface circuit 1220 of the illustrated example also includes a communication device such as a transmitter, a receiver, a transceiver, a modem and/or network interface card to facilitate exchange of data with external machines (e.g., computing devices of any kind) via a network 1226 (e.g., an Ethernet connection, a digital subscriber line (DSL), a telephone line, coaxial cable, a cellular telephone system, etc.).

The processor platform 1200 of the illustrated example also includes one or more mass storage devices 1228 for storing software and/or data. Examples of such mass storage devices 1228 include floppy disk drives, hard drive disks, compact disk drives, Blu-ray disk drives, RAID systems, and digital versatile disk (DVD) drives.

Coded instructions 1232 to implement the methods of FIGS. 7-11 may be stored in the mass storage device 1228, in the volatile memory 1214, in the non-volatile memory 1216, and/or on a removable tangible computer readable storage medium such as a CD or DVD.

From the foregoing, it will be appreciated that the above disclosed methods, apparatus and articles of manufacture substantially mitigate rod float on the downstroke of a pumping unit in heavy oil applications; substantially avoid the regenerative portion of the stroke of a pumping unit; maximize the number of strokes-per-minute for a pumping unit; and/or reduce and/or minimize stress ranges on the polished rod of a pumping unit. In some examples, the examples disclosed herein control the polished rod speed and/or load.

In an underdisplaced well, it may be advantageous to increase the overall strokes per minute (SPM) of the pumping unit. In some such examples, controlling the speed of the polished rod may reduce an amount of time to complete the downstroke portion of the pumping unit cycle. Thus, by monitoring and/or controlling the load on the polished rod, the pumping unit may move the polished rod at a more constant speed during the downstroke portion of the cycle, thereby increasing the overall strokes per minute. In some examples, to obtain a substantially constant downstroke speed, a processor may increase the motor speed at the top and bottom portions of the downstroke and moderate and/or decrease the motor speed during the middle portions of the downstroke.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

What is claimed is:

1. An apparatus, comprising:

a housing; and a processor positioned in the housing, the processor to:

determine a first angle of a crank arm of a pumping unit;

determine a first torque factor for the pumping unit, the first torque factor comprises a rate of change in a position of a polished rod with respect to an angle of the crank arm of the pumping unit;

based on the first angle of the crank arm, the first torque factor, and a reference polished rod speed, determine a rate at which to operate a motor of a pumping unit to enable the polished rod to move within a threshold of the reference polished rod speed; and cause the motor to operate at the determined rate.

2. The apparatus of claim 1, wherein the polished rod speed is to enable a load on the polished rod to be within a threshold of the reference polished rod load.

3. The apparatus of claim 1, wherein the processor is to determine the torque factor based on first and second positions of the polished rod, the first crank arm angle, and a second crank arm angle.

4. The apparatus of claim 1, wherein the first angle of the crank arm is based on a reference table.

5. A method, comprising:

determining a first angle of a crank arm of a pumping unit;

determining a first torque factor for the pumping unit, the first torque factor comprises a rate of change in a position of a polished rod with respect to an angle of the crank arm of the pumping unit; and based on the first angle of the crank arm, the first torque factor, and a reference polished rod speed, determining a rate at which to operate a motor of the pumping unit to enable the polished rod to move at the reference polished rod speed.

6. The method of claim 5, further comprising causing the motor to move at the determined rate.

7. The method of claim 5, wherein the first angle of the crank arm is based on a reference table.

8. The method of claim 5, further comprising determining a first position of the polished rod associated with the first angle of the crank arm.

9. The method of claim 8, further comprising determining a second position of the polished rod and a second angle of the crank arm.

10. The method of claim 9, wherein the first torque factor is determined based on the first and second positions of the polished rod and the first and second angles of the crank arm.

11. The method of claim 5, wherein determining the first angle of the crank arm of the pumping unit comprises monitoring a pulse count of the motor and comparing the pulse count to reference data to identify the first angle as being associated with the pulse count.

12. The method of claim 5, wherein determining the torque factor comprises using a backward difference calculation.

13. The method of claim 5, wherein determining the first torque factor comprises determining positions of the polished rod at first and second times and determining angles of the crank arm at the first and second times.

14. A method comprising:

moving a polished rod through a first cycle of a pumping unit using a motor;

determining first pulse count values of the motor through the first cycle using a first sensor;

determining first position values of the polished rod through the first cycle using a second sensor;

associating the first pulse count values with respective ones of the first position values to calibrate a processor of the pumping unit;

generating a reference table using the first pulse count values and the first position values to show a correlation between the first pulse count values and the first position values;

determining a first angle of a crank arm of the pumping unit based on the reference table;

determining a first torque factor for the pumping unit, the first torque factor comprises a rate of change in a position of the polished rod with respect to an angle of the crank arm of the pumping unit; and based on the first angle of the crank arm, the first torque factor, and a reference polished rod speed, determining a rate at which to operate a motor of the pumping unit to enable the polished rod to move at the reference polished rod speed.

15. A method, comprising:

determining a first angle of a crank arm of a pumping unit;

determining a first torque factor for the pumping unit, the first torque factor comprises a rate of change in a position of a polished rod with respect to an angle of the crank arm;

determining a first load on the polished rod at a first time;

comparing the first load to a reference load; and based on the comparison between the first and reference loads, determining a speed at which to operate the polished rod to enable a second determined load on the polished rod at a second time to be within a threshold of the reference load; and based on the first angle of the crank arm, the first torque factor, and the determined polished rod speed, determining a rate at which to operate a motor of the pumping unit to enable the polished rod to move at the determined polished rod speed.

16. The method of claim 15, further comprising causing the motor to move at the determined rate.

17. The method of claim 15, wherein the first angle of the crank arm is based on a reference table.

18. The method of claim 15, further comprising determining a first position of the polished rod associated with the first angle of the crank arm.

19. The method of claim 18, further comprising determining a second position of the polished rod and, based on the second position of the polished rod, determining a second angle of the crank arm.

20. The method of claim 19, wherein the first torque factor is determined based on the first and second positions of the polished rod and the first and second angles of the crank arm.

21. The method of claim 15, wherein determining the first load of the polished rod includes referencing a dynometer card.

22. A method, comprising:

moving a polished rod through a first cycle of a pumping unit using a motor;

determining first pulse count values of the motor through the first cycle using a first sensor;

determining first position values of the polished rod through the first cycle using a second sensor;

associating the first pulse count values with respective ones of the first position values to calibrate a processor of the pumping unit;

generating a reference table using the first pulse count values and the first position values to show a correlation between the first pulse count values and the first position values;

determining a first angle of a crank arm of the pumping unit based on the reference table;

determining a first torque factor for the pumping unit, the first torque factor comprises a rate of change in a position of the polished rod with respect to an angle of the crank arm;

determining a first load on the polished rod;

comparing the first load to a reference load; and based on the comparison between the first and reference loads, determining a speed at which to operate the polished rod to enable a second determined load on the polished rod at a second time to be within a threshold of the reference load.

* * * * *